US010255861B2

(12) United States Patent
Chen

(10) Patent No.: US 10,255,861 B2
(45) Date of Patent: Apr. 9, 2019

(54) GATE DRIVING CIRCUIT, ARRAY SUBSTRATE, DISPLAY PANEL AND DRIVING METHOD THEREOF

(71) Applicants: BOE TECHNOLOGY GROUP CO., LTD., Beijing (CN); BEIJING BOE DISPLAY TECHNOLOGY CO., LTD., Beijing (CN)

(72) Inventor: Huabin Chen, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/541,696

(22) PCT Filed: Jan. 3, 2017

(86) PCT No.: PCT/CN2017/000022
§ 371 (c)(1),
(2) Date: Jul. 5, 2017

(87) PCT Pub. No.: WO2017/190521
PCT Pub. Date: Nov. 9, 2017

(65) Prior Publication Data

US 2018/0277044 A1 Sep. 27, 2018

(30) Foreign Application Priority Data

May 4, 2016 (CN) ..... 2016 1 0287717

(51) Int. Cl.
*G09G 3/3266* (2016.01)
*G09G 3/36* (2006.01)
*G09G 3/20* (2006.01)

(52) U.S. Cl.
CPC ..... *G09G 3/3266* (2013.01); *G09G 3/20* (2013.01); *G09G 3/36* (2013.01); *G09G 3/3677* (2013.01);
(Continued)

(58) Field of Classification Search
CPC ..... G09G 3/3266; G09G 3/3677; G09G 2310/021; G09G 2310/0291; G09G 2310/0283; G09G 3/20; G09G 3/36
See application file for complete search history.

(56) References Cited

U.S. PATENT DOCUMENTS 8,803,783 B2 * 8/2014 Ochiai ..... G09G 3/3677 345/100
2006/0279511 A1 * 12/2006 Uh ..... G11C 19/184 345/100
(Continued)

FOREIGN PATENT DOCUMENTS

CN 102610185 A 7/2012
CN 102637401 A 8/2012
(Continued)

OTHER PUBLICATIONS

International Search Report and Written Opinion in PCT/CN2016/000022 dated Mar. 31, 2017, with English translation.
(Continued)

*Primary Examiner* — Grant Sitta
(74) *Attorney, Agent, or Firm* — Womble Bond Dickinson (US) LLP

(57) ABSTRACT

A gate driving circuit is disclosed which includes n stages that are sequentially arranged, n being an integer larger than or equal to 4. The n stages are divided into a first, second, third and fourth sets of stages that are configured to receive respective different combinations of a first clock signal, a second clock signal, a third clock signal and a fourth clock
(Continued)

signal. The stages in the first set of stages and the stages in the third set of stages are cascaded with each other, and the stages in the second set of stages and the stages in the fourth set of stages are cascaded with each other. Also disclosed are an array substrate including the gate driving circuit, a display panel including the array substrate, and a driving method of the display panel.

15 Claims, 8 Drawing Sheets

(52) U.S. Cl.
CPC ..... *G09G 2310/021* (2013.01); *G09G 2310/0283* (2013.01); *G09G 2310/0291* (2013.01)

(56) References Cited

U.S. PATENT DOCUMENTS

2007/0040771 A1* 2/2007 Chung ..... G11C 19/00 345/76
2011/0080393 A1* 4/2011 Kim ..... G09G 3/3266 345/208
2011/0273434 A1 11/2011 Park
2012/0038609 A1* 2/2012 Chung ..... G09G 3/003 345/211
2012/0081409 A1* 4/2012 Chung ..... G09G 3/3266 345/690
2012/0105423 A1* 5/2012 Chung ..... G09G 3/3266 345/212
2012/0188290 A1* 7/2012 Park ..... G09G 3/3266 345/690
2012/0194489 A1 8/2012 Iwamoto et al.
2014/0055329 A1* 2/2014 Ohara ..... G09G 3/3677 345/87
2014/0072093 A1 3/2014 Shang et al.
2014/0340293 A1* 11/2014 Ochiai ..... G09G 3/3677 345/98
2015/0187323 A1 6/2015 Jin et al.
2015/0255034 A1* 9/2015 Hong ..... G09G 3/3674 345/214
2015/0302936 A1* 10/2015 Ma ..... G11C 19/184 377/64
2016/0012764 A1* 1/2016 Xu ..... G11C 19/28 345/204
2016/0104449 A1 4/2016 Huang
2016/0247446 A1* 8/2016 Cao ..... G09G 3/3225

FOREIGN PATENT DOCUMENTS

CN 102708818 A 10/2012
CN 103927960 A 7/2014
CN 105513524 A 4/2016
CN 105741808 A 7/2016
KR 20080001890 A 1/2008
TW 201614665 A 4/2016
WO 2011/055570 A1 5/2011

OTHER PUBLICATIONS

Office Action received for Chinese Patent Application No. 201610287717.8, dated Oct. 20, 2017, 12 pages. (6 pages of English Translation and 6 pages of Office Action).
International Search Report and Written Opinion in PCT/CN2017/000022 dated Mar. 31, 2017, with English translation.

* cited by examiner

GATE DRIVING CIRCUIT, ARRAY SUBSTRATE, DISPLAY PANEL AND DRIVING METHOD THEREOF

CROSS-REFERENCE TO RELATED APPLICATIONS

The present application is the U.S. national phase entry of PCT/CN2017/000022, with an international filing date of Jan. 3, 2017, which claims the benefit of Chinese Patent Application No. 201610287717.8, filed on May 4, 2016, the entire disclosures of which are incorporated herein by reference.

TECHNICAL FIELD

The present disclosure relates to the field of display technology, and particularly to a gate driving circuit, an array substrate, a display panel and a driving method thereof.

BACKGROUND

A display apparatus comprises an array substrate on which a pixel array is formed, a gate driving circuit and a data driving circuit. The gate driving circuit sequentially turns on the pixel lines in the pixel array such that data voltages output by the data driving circuit can be applied to corresponding pixels. In some applications, the gate driving circuit is formed on the array substrate and is referred to as "gate driver on array" (GOA).

Gate driving circuits with a dual scan capability have been widely used. In a forward scanning mode, the gate driving circuit sequentially turns on the pixel lines from top to bottom. In a reverse scanning mode, the gate driving circuit sequentially turns on the pixel lines from bottom to top. Typically, additional signal lines are required to achieve the dual scan.

SUMMARY

It would be advantageous to provide a gate driving circuit that achieves the dual scan based on two scan start signals and four clock signals. It would also be desirable to provide an array substrate comprising the gate driving circuit, a display panel comprising the array substrate, and a driving method of the display panel.

According to a first aspect of the present disclosure, a gate driving circuit is provided which comprises n stages that are sequentially arranged, n being an integer larger than or equal to 4. The n stages are divided into a first set of stages comprising a (4k+1)-th stage of the n stages, a second set of stages comprising a (4k+2)-th stage of the n stages, a third set of stages comprising a (4k+3)-th stage of the n stages, and a fourth set of stages comprising a 4(k+1)-th stage of the n stages, k being an integer larger than or equal to 0. The first, second, third and fourth sets of stages are configured to receive respective different combinations of a first clock signal, a second clock signal, a third clock signal and a fourth clock signal. The stages in the first set of stages and the stages in the third set of stages are cascaded with each other, and the stages in the second set of stages and the stages in the fourth set of stages are cascaded with each other. First two of the n stages are configured to receive a first scan start signal and last two of the n stages are configured to receive a second scan start signal.

In some embodiments, the gate driving circuit further comprises a first clock line for transmitting the first clock signal, a second clock line for transmitting the second clock signal, a third clock line for transmitting the third clock signal, and a fourth clock line for transmitting the fourth clock signal. Each of the n stages comprises a first clock terminal, a second clock terminal, a third clock terminal and a fourth clock terminal. The first clock line is connected to the third clock terminal of each stage in the first set of stages, the second clock terminal of each stage in the second set of stages, the first clock terminal of each stage in the third set of stages, and the fourth clock terminal of each stage in the fourth set of stages. The second clock line is connected to the fourth clock terminal of each stage in the first set of stages, the third clock terminal of each stage in the second set of stages, the second clock terminal of each stage in the third set of stages, and the first clock terminal of each stage in the fourth set of stages. The third clock line is connected to the first clock terminal of each stage in the first set of stages, the fourth clock terminal of each stage in the second set of stages, the third clock terminal of each stage in the third set of stages, and the second clock terminal of each stage in the fourth set of stages. The fourth clock line is connected to the second clock terminal of each stage in the first set of stages, the first clock terminal of each stage in the second set of stages, the fourth clock terminal of each stage in the third set of stages, and the third clock terminal of each stage in the fourth set of stages.

In some embodiments, the gate driving circuit further comprises a first scan start signal line for transmitting the first scan start signal and a second scan start signal line for transmitting the second scan start signal. Each of the n stages further comprises an input terminal, an output terminal, a reset terminal, and a gate-off voltage terminal configured to receive a gate-off voltage. The output terminal of each stage in the first set of stages is connected to the input terminal of a respective next stage in the third set of stages, and the output terminal of each stage in the third set of stages is connected to the reset terminal of a respective previous stage in the first set of stages and the input terminal of a respective next stage in the first set of stages. The output terminal of each stage in the second set of stages is connected to the input terminal of a respective next stage in the fourth set of stages, and the output terminal of each stage in the fourth set of stages is connected to the reset terminal of a respective previous stage in the second set of stages and the input terminal of a respective next stage in the second set of stages. The input terminals of the first two of the n stages are connected to the first scan start signal line, and the reset terminals of the last two of the n stages are connected to the second scan start signal line.

In some embodiments, each of the n stages comprises: a first node; a buffering part operable to selectively supply to the first node a signal applied to the second clock terminal or a signal applied to the fourth clock terminal in dependence on a signal applied to the input terminal and a signal applied to the reset terminal; a charging part operable to be charged with the signal supplied by the buffering part to the first node; a pull-up part operable to selectively supply a signal applied to the third clock terminal to the output terminal in dependence on a voltage at the first node; a pull-down part operable to supply a signal applied to the gate-off voltage terminal to the output terminal in dependence on the signal applied to the input terminal and the signal applied to the reset terminal; and a holding part operable to hold supplying of the signal applied to the gate-off voltage terminal to the output terminal in dependence on a signal applied to the first clock terminal.

In some embodiments, the buffering part comprises a first transistor and a second transistor. The first transistor comprises a gate electrode connected to the input terminal, a first electrode connected to the first node, and a second electrode connected to the second clock terminal. The second transistor comprises a gate electrode connected to the reset terminal, a first electrode connected to the fourth clock terminal, and a second electrode connected to the first node.

In some embodiments, the charging part comprises a first capacitor comprising a first terminal connected to the first node and a second terminal connected to the output terminal.

In some embodiments, the pull-up part comprises a third transistor comprising a gate electrode connected to the first node, a first electrode connected to the output terminal, and a second electrode connected to the third clock terminal.

In some embodiments, the pull-down part comprises a fourth transistor and a seventh transistor. The fourth transistor comprises a gate electrode connected to the reset terminal, a first electrode connected to the gate-off voltage terminal, and a second electrode connected to the output terminal. The seventh transistor comprises a gate electrode connected to the input terminal, a first electrode connected to the gate-off voltage terminal, and a second electrode connected to the output terminal.

In some embodiments, each of the n stages further comprises a second node and a third node, and the holding part comprises a fifth transistor, a ninth transistor, a tenth transistor and an eleventh transistor. The fifth transistor comprises a gate electrode connected to the second node, a first electrode connected to the third node, and a second electrode connected to the first clock terminal. The ninth transistor comprises a gate electrode connected to the first clock terminal, a first electrode connected to the second node, and a second electrode connected to the first clock terminal. The tenth transistor comprises a gate electrode connected to the third node, a first electrode connected to the gate-off voltage terminal, and a second electrode connected to the first node. The eleventh transistor comprises a gate electrode connected to the third node, a first electrode connected to the gate-off voltage terminal, and a second electrode connected to the output terminal.

In some embodiments, the buffering part further comprises a sixth transistor and an eighth transistor. The sixth transistor comprises a gate electrode connected to the first node, a first electrode connected to the gate-off voltage terminal, and a second electrode connected to the third node. The eighth transistor comprises a gate electrode connected to the first node, a first electrode connected to the gate-off voltage terminal, and a second electrode connected to the second node.

In some embodiments, the gate driving circuit is configured to operate in a forward scanning mode in response to application of the first scan start signal to the input terminals of the first two of the n stages.

In some embodiments, each of the first, second, third and fourth clock signals is a pulse signal periodically repeated with a period of 2H. H is a horizontal scan period. The first clock signal and the third clock signal have a phase difference of 180 degrees. The second clock signal and the fourth clock signal have a phase difference of 180 degrees. The first clock signal precedes the fourth clock signal by 90 degrees in terms of the phase.

In some embodiments, the first scan start signal is a pulse signal having a pulse width of 1.5H or 1H, and a rising edge of the first scan start signal is synchronized with a rising edge of the third clock signal.

In some embodiments, the gate driving circuit is configured to operate in a reverse scanning mode in response to application of the second scan start signal to the reset terminals of the last two of the n stages.

In some embodiments, each of the first, second, third and fourth clock signals is a pulse signal periodically repeated with a period of 2H. H is a horizontal scan period. The first clock signal and the third clock signal have a phase difference of 180 degrees. The second clock signal and the fourth clock signal have a phase difference of 180 degrees. The first clock signal falls behind the fourth clock signal by 90 degrees in terms of the phase.

In some embodiments, the second scan start signal is a pulse signal having a pulse width of 1.5H or 1H, and a rising edge of the second scan start signal is synchronized with a rising edge of the second clock signal.

According to another aspect of the present disclosure, an array substrate is provided which comprises a display area comprising a plurality of gate lines and a plurality of data lines intersecting the plurality of gate lines, and the gate driving circuit as described above. The gate driving circuit is formed in a peripheral area of the array substrate other than the display area and configured to supply gate signals to the plurality of gate lines.

According to yet another aspect of the present disclosure, a display panel is provided which comprises the array substrate as described above.

According to still another aspect of the present disclosure, a method of driving the display panel as described above is provided which comprises: driving the display panel to operate in a forward scanning mode by supplying the gate driving circuit with the first, second, third and fourth clock signals and the first scan start signal, wherein: each of the first, second, third and fourth clock signals is a pulse signal periodically repeated with a period of 2H, H is a horizontal scan period, the first clock signal and the third clock signal have a phase difference of 180 degrees, the second clock signal and the fourth clock signal have a phase difference of 180 degrees, the first clock signal precedes the fourth clock signal by 90 degrees in terms of the phase, the first scan start signal is a pulse signal having a pulse width of 1.5H or 1H, and a rising edge of the first scan start signal is synchronized with a rising edge of the third clock signal; and driving the display panel to operate in a reverse scanning mode by supplying the gate driving circuit with the first, second, third and fourth clock signals and the second scan start signal, wherein: each of the first, second, third and fourth clock signals is a pulse signal periodically repeated with a period of 2H, H is a horizontal scan period, the first clock signal and the third clock signal have a phase difference of 180 degrees, the second clock signal and the fourth clock signal have a phase difference of 180 degrees, the first clock signal falls behind the fourth clock signal by 90 degrees in terms of the phase, the second scan start signal is a pulse signal having a pulse width of 1.5H or 1H, and a rising edge of the second scan start signal is synchronized with a rising edge of the second clock signal.

These and other aspects of the present disclosure will be apparent from and elucidated with reference to the embodiment(s) described hereinafter.

BRIEF DESCRIPTION OF THE DRAWINGS

Further details, features and advantages of the disclosure are disclosed in the following description of exemplary embodiments in connection with the accompanying drawings, in which.

DETAILED DESCRIPTION

Figure 1:
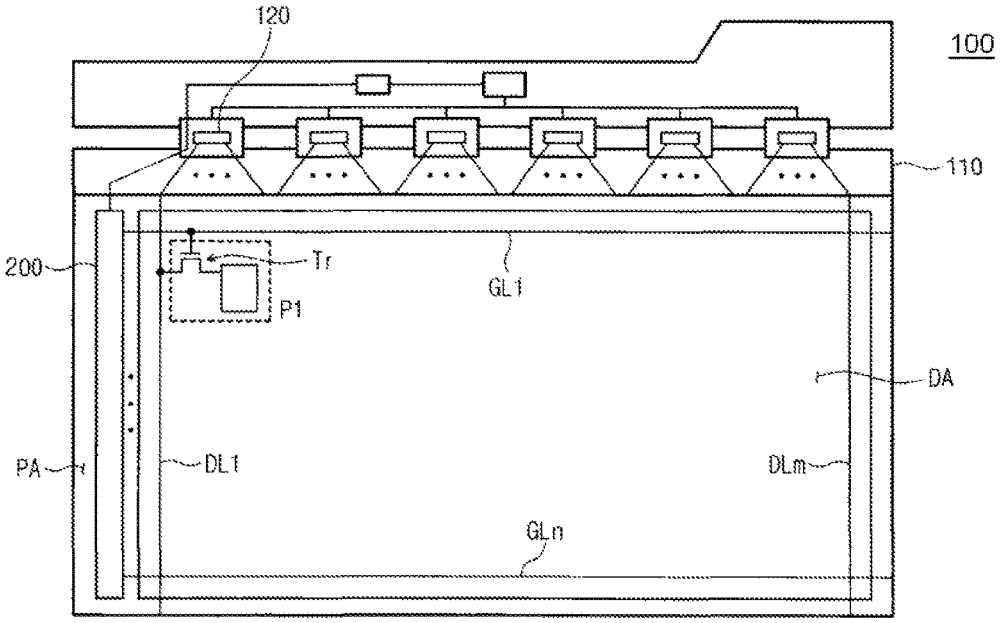
FIG. 1 is a plan view schematically illustrating a display panel according to an embodiment of the present disclosure.

The disclosure will now be described more fully hereinafter with reference to the accompanying drawings, in which exemplary embodiments of the disclosure are shown. The present disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art. Like reference numerals refer to like elements throughout.

FIG. 1 is a plan view schematically illustrating a display panel 100 according to an embodiment of the present disclosure.

Referring to FIG. 1, the display panel 100 comprises an array substrate 110, a data driving circuit(s) 120 for outputting data voltages, and a gate driving circuit 200 for outputting gate signals. As shown in FIG. 1, the array substrate 110 comprises a display area DA in which an image is displayed and a peripheral area PA other than the display area DA.

Provided in the display area DA are gate lines GL1-GLn and data lines DL1-DLm that are insulated from the gate lines GL1-GLn. The data lines DL1-DLm and the gate lines GL1-GLn intersect with each other to define a plurality of pixels. The pixels are arranged in an array in the display area DA and have substantially the same structure and function. Thus, only one pixel P1, as indicated by the dashed box, is described in more detail. In an exemplary embodiment, the pixel P1 comprises a thin film transistor Tr comprising a gate electrode connected to the gate line GL1 and a first electrode connected to the data line DL1. Where the display panel 100 is a liquid crystal display panel, a second electrode of the thin film transistor Tr is connected to a pixel electrode. Where the display panel 100 is an organic light-emitting diode (OLED) display panel, the second electrode of the thin film transistor Tr is connected to e.g. a gate electrode of a driving transistor that supplies a driving current to the OLED.

The gate driving circuit 200 is provided in the peripheral area PA and connected to the gate lines GL1-GLn to sequentially output the gate signals to the gate lines GL1-GLn. In an exemplary embodiment, the gate driving circuit 200 may be formed simultaneously with the thin film transistor Tr of the pixel in a manufacturing process of the thin film transistor Tr, resulting in a GOA circuit. In another exemplary embodiment, the gate driving circuit 200 may be formed as a separate integrated circuit (IC) chip and mounted directly on the display panel 100 or a separate printed circuit board (not shown). In addition, the data driving circuits 120 are provided in the peripheral area PA and connected to the data lines DL1-DLm to output the data voltages to the data lines DL1-DLm.

Figure 2:
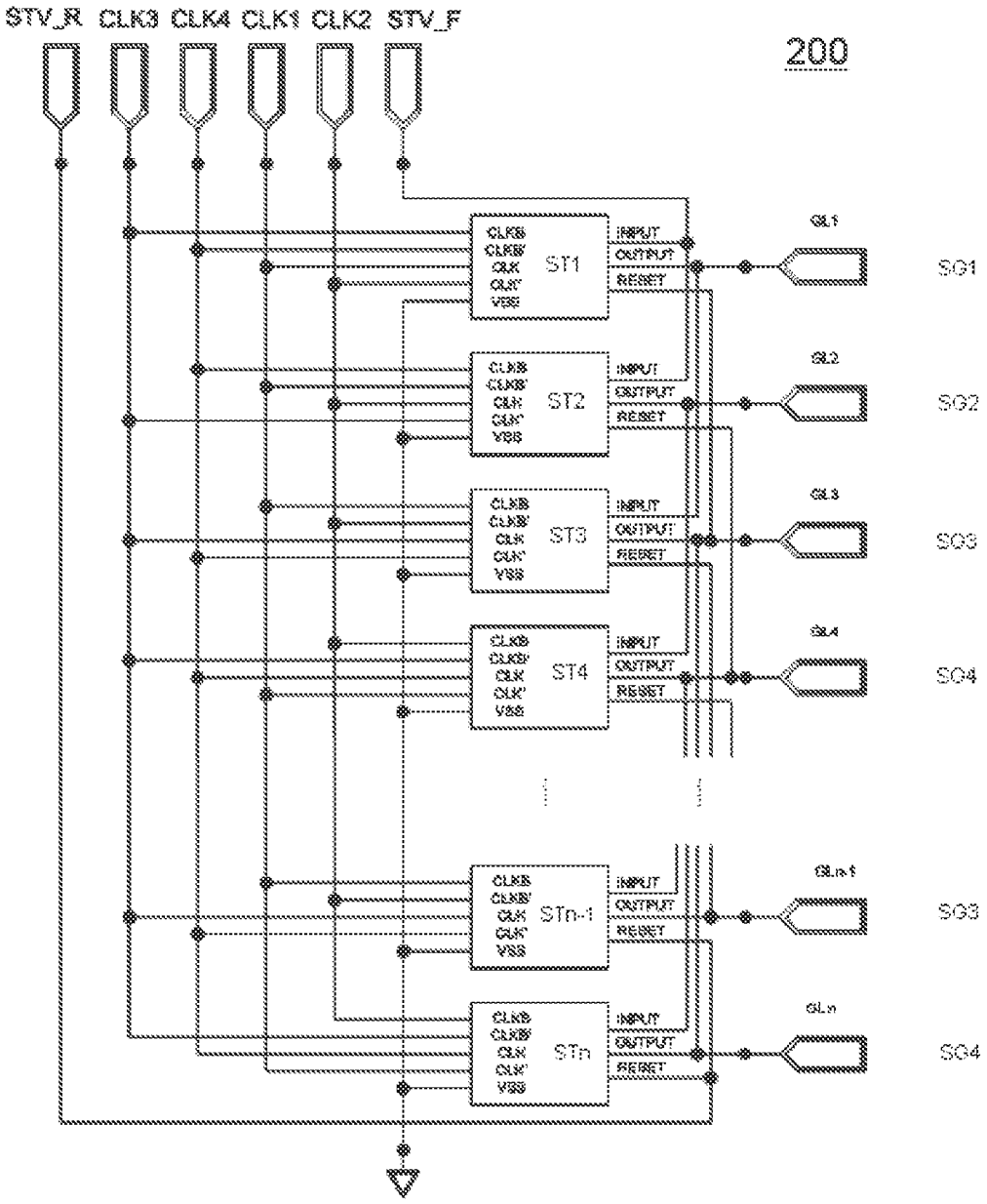
FIG. 2 is a block diagram schematically illustrating a gate driving circuit according to an embodiment of the present disclosure.

FIG. 2 is a block diagram schematically illustrating the gate driving circuit 200 according to an embodiment of the present disclosure.

Referring to FIG. 2, the gate driving circuit 200 comprises n stages ST1, ST2, . . . STn−1, STn that are sequentially arranged, where n is an integer larger than or equal to 4. The n stages ST1, ST2, . . . STn−1, STn together form a shift register.

Each of the n stages ST1, ST2, . . . STn−1, STn has a first clock terminal CLKB, a second clock terminal CLKB', a third clock terminal CLK, a fourth clock terminal CLK', a gate-off voltage terminal VSS, an input terminal INPUT, an output terminal OUTPUT, and a reset terminal RESET.

As shown in FIG. 2, the output terminals OUTPUT of the n stages ST1, ST2, . . . STn−1, STn are connected to corresponding gate lines GL1, GL2, . . . GLn−1, GLn and output corresponding gate signals. The gate signals have a high level as a gate-on voltage and a low level as a gate-off voltage. The gate-off voltage may be supplied via the gate-off voltage terminal.

The n stages ST1, ST2, . . . STn−1, STn are divided into a first set of stages SG1, a second set of stages SG2, a third set of stages SG3, and a fourth set of stages SG4. The first set of stages SG1 comprises a (4k+1)-th stage of the n stages, the second set of stages SG2 comprises a (4k+2)-th stage of the n stages, the third set of stages SG3 comprises a (4k+3)-th stage of the n stages, and the fourth set of stages SG4 comprises a 4(k+1)-th stage of the n stages, where k is an integer larger than or equal to 0.

In FIG. 2, the reference signs "SG1", "SG2", "SG3" and "SG4" at the far right indicate the sets of stages to which respective stages ST1, ST2, . . . STn−1, STn pertain. For example, the first stage ST1 pertains to the first set of stages SG1, the second stage ST2 pertains to the second set of stages SG2, the third stage ST3 pertains to the third set of stages SG3, the fourth stage ST4 pertains to the fourth set of stages SG4, the fifth stage ST5 (not shown) pertains to the first set of stages SG1, and the like.

It will be understood that although the number of the stages shown in FIG. 2 is an integral multiple of 4 (since the last stage STn pertains to the set of stages SG4), other numbers are possible in other embodiments.

The first, second, third and fourth sets of stages SG1, SG2, SG3, SG4 are configured to receive respective different combinations of a first clock signal CLK1, a second clock signal CLK2, a third clock signal CLK3 and a fourth clock signal CLK4, via their respective first, second, third and fourth clock terminals CLKB, CLKB', CLK, CLK'.

Specifically, each stage in the first set of stages SG1 is configured to receive a first combination of these four clock signals, each stage in the second set of stages SG2 is configured to receive a second combination of these four clock signals, each stage in the third set of stages SG3 is configured to receive a third combination of these four clock signals, and each stage in the fourth set of stages SG4 is configured to receive a fourth combination of these four clock signals.

More specifically, referring to FIG. 2, a first clock line transmitting the first clock signal CLK1 is connected to the third clock terminal CLK of each stage in the first set of stages SG1, the second clock terminal CLKB' of each stage in the second set of stages SG2, the first clock terminal CLKB of each stage in the third set of stages SG3, and the fourth clock terminal CLK' of each stage in the fourth set of stages SG4. A second clock line transmitting the second clock signal CLK2 is connected to the fourth clock terminal CLK' of each stage in the first set of stages SG1, the third clock terminal CLK of each stage in the second set of stages SG2, the second clock terminal CLKB' of each stage in the third set of stages SG3, and the first clock terminal CLKB of each stage in the fourth set of stages SG4. A third clock line transmitting the third clock signal CLK3 is connected to the first clock terminal CLKB of each stage in the first set of stages SG1, the fourth clock terminal CLK' of each stage in the second set of stages SG2, the third clock terminal CLK of each stage in the third set of stages SG3, and the second clock terminal CLKB' of each stage in the fourth set of stages SG4. A fourth clock line transmitting the fourth clock signal CLK4 is connected to the second clock terminal CLKB' of each stage in the first set of stages SG1, the first clock terminal CLKB of each stage in the second set of stages SG2, the fourth clock terminal CLK' of each stage in the third set of stages SG3, and the third clock terminal CLK of each stage in the fourth set of stages SG4.

The stages in the first set of stages SG1 and the stages in the third set of stages SG3 are cascaded with each other, and the stages in the second set of stages SG2 and the stages in the fourth set of stages SG4 are cascaded with each other.

Specifically, referring to FIG. 2, the output terminal OUTPUT of each stage in the first set of stages SG1 is connected to the input terminal INPUT of a respective next stage in the third set of stages SG3, and the output terminal OUTPUT of each stage in the third set of stages SG3 is connected to the reset terminal RESET of a respective previous stage in the first set of stages SG1 and the input terminal INPUT of a respective next stage in the first set of stages SG1. The output terminal OUTPUT of each stage in the second set of stages SG2 is connected to the input terminal INPUT of a respective next stage in the fourth set of stages SG4, and the output terminal OUTPUT of each stage in the fourth set of stages SG4 is connected to the reset terminal RESET of a respective previous stage in the second set of stages SG2 and the input terminal INPUT of a respective next stage in the second set of stages SG2.

Further, the first two stages ST1 and ST2 of the n stages ST1, ST2, . . . STn−1, STn are configured to receive a first scan start signal STV_F and the last two stages STn−1 and STn of the n stages ST1, ST2, . . . STn−1, STn are configured to receive a second scan start signal STV_R.

Specifically, the input terminals INPUT of the first two stages ST1 and ST2 of the n stages ST1, ST2, . . . STn−1, STn are connected to the first scan start signal line that transmits the first scan start signal STV_F, and the reset terminals RESET of the last two stages STn−1 and STn of the n stages ST1, ST2, . . . STn−1, STn are connected to the second scan start signal line that transmits the second scan start signal STV_R.

As will be described later, the gate driving circuit 200 operates in a forward scanning mode in response to the first scan start signal STV_F, and operates in a reverse scanning mode in response to the second scan start signal STV_R. The first clock signal CLK1, the second clock signal CLK2, the third clock signal CLK3 and the fourth clock signal CLK4 have a first timing pattern in the forward scanning mode, and a second timing pattern in the reverse scanning mode. The second timing pattern is different from the first timing pattern.

Therefore, switching between the forward scanning and the reverse scanning can be achieved by using one of the two scan start signals and by changing the timing of the clock signals, without a need of additional signal lines. This may facilitate simplification of the circuit and thus a reduction of the circuit footprint.

Figure 3:
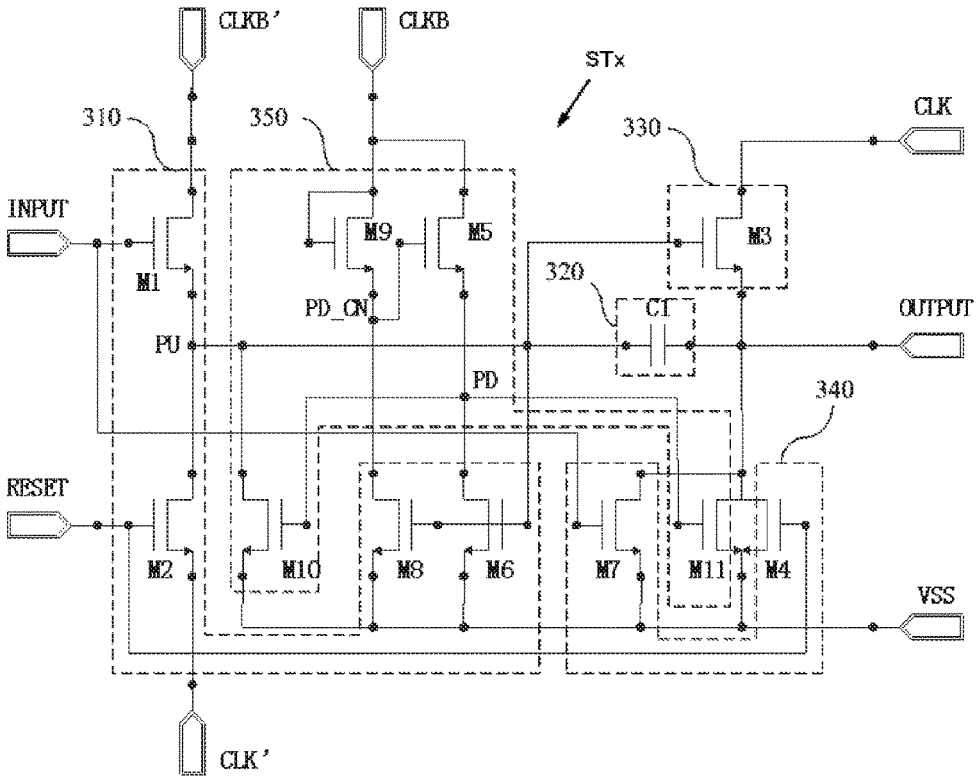
FIG. 3 is a circuit diagram schematically illustrating a stage of the gate driving circuit as shown in FIG. 2.

FIG. 3 is a circuit diagram schematically illustrating a stage STx of the gate driving circuit 200 as shown in FIG. 2. The stages in the gate driving circuit 200 have the same structure. Thus, the stage STx as shown in FIG. 3 may represent any one of the n stages ST1, ST2, . . . STn−1, STn.

Referring to FIG. 3, the stage STx comprises a first node PU, a buffering part 310, a charging part 320, a pull-up part 330, a pull-down part 340 and a holding part 350.

The buffering part 310 is operable to selectively supply to the first node PU a signal applied to the second clock terminal CLKB' or a signal applied to the fourth clock terminal CLK' in dependence on a signal applied to the input terminal INPUT and a signal applied to the reset terminal RESET.

The term buffering, as used herein, refers to an operation of charging the first node PU, as will be described later.

Specifically, the buffering part 310 comprises a first transistor M1 and a second transistor M2. The first transistor M1 comprises a gate electrode connected to the input terminal INPUT, a first electrode connected to the first node PU, and a second electrode connected to the second clock terminal CLKB'. The second transistor M2 comprises a gate electrode connected to the reset terminal RESET, a first electrode connected to the fourth clock terminal CLK', and a second electrode connected to the first node PU.

Further, in an exemplary embodiment, the buffering part 310 further comprises a sixth transistor M6 and an eighth transistor M8. The sixth transistor M6 comprises a gate electrode connected to the first node PU, a first electrode connected to the gate-off voltage terminal VSS, and a second electrode connected to a third node PD. The eighth transistor M8 comprises a gate electrode connected to the first node PU, a first electrode connected to the gate-off voltage terminal VSS, and a second electrode connected to a second node PD_CN.

The charging part 320 is operable to be charged with the signal supplied by the buffering part 310 to the first node PU.

Specifically, the charging part 320 comprises a first capacitor C1. The first capacitor C1 comprises a first terminal connected to the first node PU and a second terminal connected to the output terminal OUTPUT.

The pull-up part 330 is operable to selectively supply a signal applied to the third clock terminal CLK to the output terminal OUTPUT in dependence on a voltage at the first node PU.

Specifically, the pull-up part 330 comprises a third transistor M3. The third transistor M3 comprises a gate electrode connected to the first node PU, a first electrode connected to the output terminal OUTPUT, and a second electrode connected to the third clock terminal CLK.

The pull-down part 340 is operable to supply a signal applied to the gate-off voltage terminal VSS to the output terminal OUTPUT in dependence on the signal applied to the input terminal INPUT and the signal applied to the reset terminal RESET.

Specifically, the pull-down part 340 comprises a fourth transistor M4 and a seventh transistor M7. The fourth transistor M4 comprises a gate electrode connected to the reset terminal RESET, a first electrode connected to the gate-off voltage terminal VSS, and a second electrode connected to the output terminal OUTPUT. The seventh transistor M7 comprises a gate electrode connected to the input terminal INPUT, a first electrode connected to the gate-off voltage terminal VSS, and a second electrode connected to the output terminal OUTPUT.

The holding part 350 is operable to hold supplying of the signal applied to the gate-off voltage terminal VSS to the output terminal OUTPUT in dependence on a signal applied to the first clock terminal CLKB.

Specifically, the holding part 350 comprises a fifth transistor M5, a ninth transistor M9, a tenth transistor M10, and an eleventh transistor M11. Referring still to FIG. 3, the stage STx further comprises the second node PD_CN and the third node PD.

The fifth transistor M5 comprises a gate electrode connected to the second node PD_CN, a first electrode connected to the third node PD, and a second electrode connected to the first clock terminal CLKB. The ninth transistor M9 comprises a gate electrode connected to the first clock terminal CLKB, a first electrode connected to the second node PD_CN, and a second electrode connected to the first clock terminal CLKB. The tenth transistor M10 comprises a gate electrode connected to the third node PD, a first electrode connected to the gate-off voltage terminal VSS, and a second electrode connected to the first node PU. The eleventh transistor M11 comprises a gate electrode connected to the third node PD, a first electrode connected to the gate-off voltage terminal VSS, and a second electrode connected to the output terminal OUTPUT.

It will be understood that although the transistors in FIG. 3 are shown as n-type transistors, p-type transistors may be employed in other embodiments. In the case of a p-type transistor, the voltage for turning on the transistor is a low level voltage, and the voltage for turning off the transistor is a high level voltage.

It will also be understood that in embodiments where the gate driving circuit 200 is implemented as a GOA the transistors are formed as thin film transistors. In the case of a thin film transistor, the source electrode and the drain electrode may be used interchangeably.

Figure 4A:
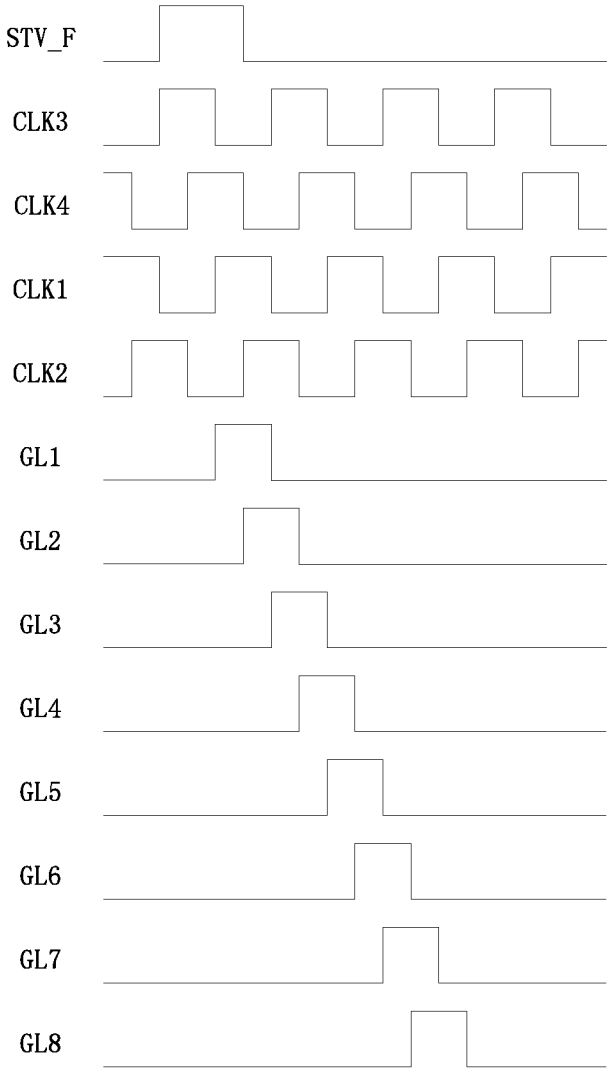
FIGS. 4A and 4B are timing diagrams schematically illustrating driving methods of the gate driving circuit as shown in FIG. 2 in a forward scanning mode and a reverse scanning mode, respectively.
Figure 4B:
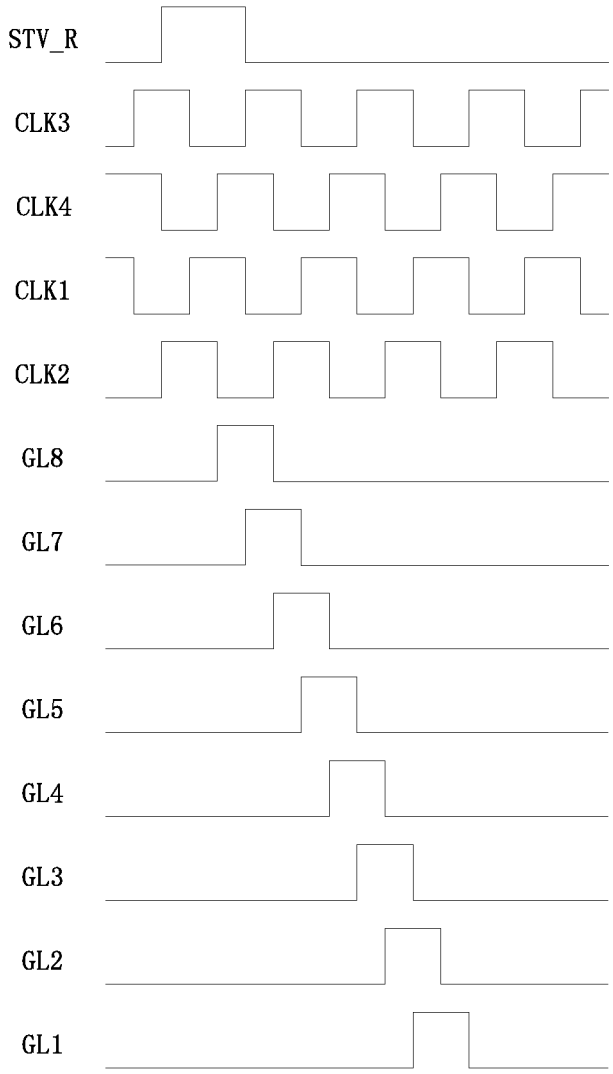
Figure 5A:
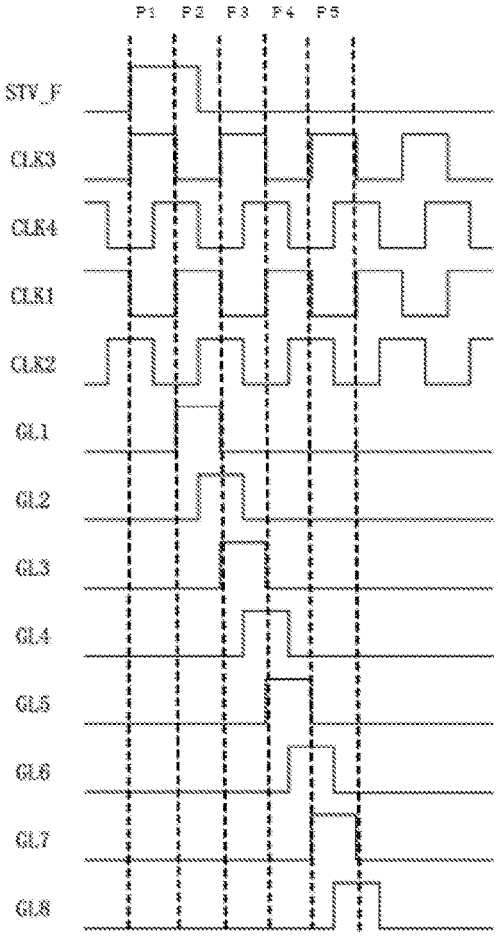
FIGS. 5A, 5B, 5C and 5D are timing diagrams schematically illustrating operations of the first, second, third and fourth stages of the gate driving circuit as shown in FIG. 2 in a forward scanning mode, respectively.
Figure 5B:
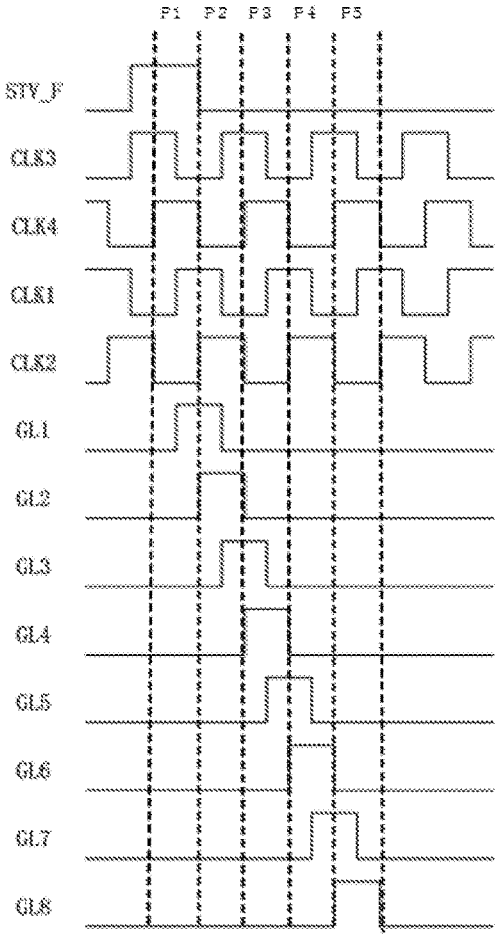
Figure 5C:
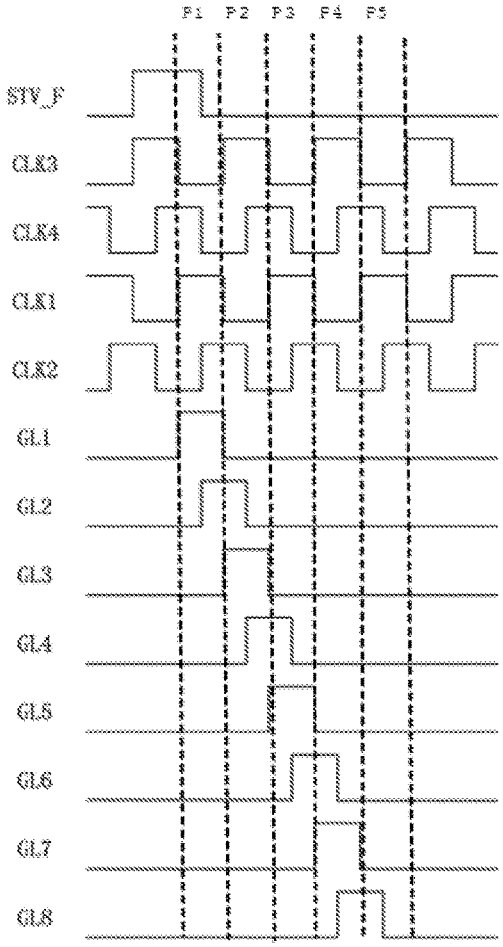
Figure 5D:
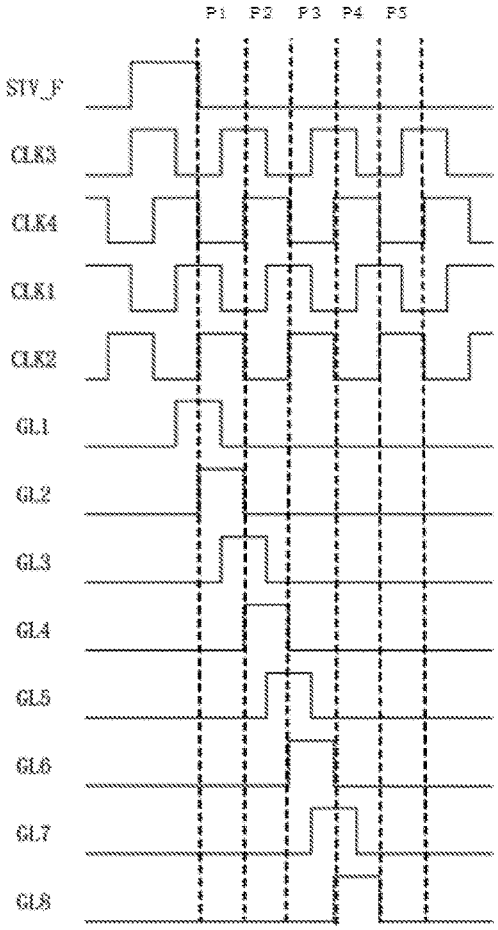

FIGS. 4A and 4B are timing diagrams schematically illustrating driving methods of the gate driving circuit 200 as shown in FIG. 2 in a forward scanning mode and a reverse scanning mode, respectively. For ease of description, assume that the gate driving circuit 200 comprises 8 stages (n=8), although other numbers of stages are possible. Accordingly, there are 8 gate lines GL1, GL2, GL8, as shown in FIGS. 4A and 4B.

As described above, the gate driving circuit 200 is configured to operate in the forward scanning mode in response to application of the first scan start signal STV_F to the input terminals INPUT of the first two of the 8 stages (i.e., ST1 and ST2). In this case, the gate signals are sequentially output to the gate lines GL1, GL2, GL8, as shown in FIG. 4A.

Referring to FIG. 4A, each of the first, second, third and fourth clock signals CLK1, CLK2, CLK3, CLK4 is a pulse signal periodically repeated with a period of 2H, where H is a horizontal scan period during which the gate signal is at a high level as a gate-on voltage.

The first clock signal CLK1, the second clock signal CLK2, the third clock signal CLK3 and the fourth clock signal CLK4 have a first timing pattern. Specifically, the first clock signal CLK1 and the third clock signal CLK3 have a phase difference of 180 degrees, the second clock signal CLK2 and the fourth clock signal CLK4 have a phase difference of 180 degrees, and the first clock signal CLK1 precedes the fourth clock signal CLK4 by 90 degrees in terms of the phase. In addition, the first scan start signal STV_F is a pulse signal having a pulse width of 1.5H, and a rising edge of the first scan start signal STV_F is synchronized with a rising edge of the third clock signal CLK3.

As described above, the gate driving circuit 200 is configured to operate in the reverse scanning mode in response to application of the second scan start signal STV_R to the reset terminals of the last two of the 8 stages (i.e., ST8 and ST7). In this case, the gate signals are sequentially output to the gate lines GL8, GL7, GL1, as shown in FIG. 4B.

In the reverse scanning mode, the first clock signal CLK1, the second clock signal CLK2, the third clock signal CLK3 and the fourth clock signal CLK4 have a second timing pattern which is different from the first timing pattern.

Referring to FIG. 4B, the first clock signal CLK1 and the third clock signal CLK3 have a phase difference of 180 degrees, the second clock signal CLK2 and the fourth clock signal CLK4 have a phase difference of 180 degrees, and the first clock signal CLK1 falls behind the fourth clock signal CLK4 by 90 degrees in terms of the phase. In addition, the second scan start signal STV_R is a pulse signal having a pulse width of 1.5H, and a rising edge of the second scan start signal STV_R is synchronized with a rising edge of the second clock signal CLK2.

Operations of the gate driving circuit 200 according to embodiments of the present disclosure are described below with reference to FIGS. 2, 3, 5A, 5B, 5C and 5D and FIGS. 6A and 6B.

FIGS. 5A, 5B, 5C and 5D are timing diagrams schematically illustrating operations of the first, second, third and fourth stages ST1, ST2, ST3, ST4 of the gate driving circuit 200 as shown in FIG. 2 in the forward scanning mode, respectively. The operations of each stage comprise five phases P1, P2, P3, P4 and P5.

The operations of the first stage ST1 are described below.

At phase P1, the high level of the first scan start signal STV_F is applied to the input terminal INPUT such that the first transistor M1 is turned on to supply the fourth clock signal CLK4 to the first node PU via the second clock terminal CLKB'. At the second half of phase P1, the first capacitor C1 is charged with the high level of the fourth clock signal CLK4, such that the sixth transistor M6 and the eighth transistor M8 are turned on to supply the gate-off voltage to the second node PD_CN and the third node PD via the gate-off voltage terminal VSS, and the third transistor M3 is turned on to prepare outputting of a high level to the gate line GL1 via the output terminal OUTPUT.

At phase P2, the high level of the first clock signal CLK1 is applied to the third clock terminal CLK, and the voltage across the first capacitor C1 maintains the third transistor M3 in an ON state, such that the high level of the first clock signal CLK1 is supplied via the third transistor M3 to the output terminal OUTPUT and output to the gate line GL1.

At phase P3, the high level of the third stage ST3 (GL3) is applied to the reset terminal RESET of the first stage ST1 such that the fourth transistor M4 is turned on to supply the gate-off voltage to the output terminal OUTPUT via the gate-off voltage terminal VSS, pulling the gate signal output to the gate line GL1 down to a low level. At the same time, the second transistor M2 is turned on to supply the second clock signal CLK2 to the first node PU via the fourth clock terminal CLK'. At the second half of phase P3, the low level of the second clock signal CLK2 is supplied to the first node PU to cause the first capacitor C1 to be discharged.

At phase P4, the transistors are in an OFF state such that the output terminal OUTPUT is floated at a low level. The gate signal output to the gate line GL1 is at the low level.

At phase P5, the high level of the third clock signal CLK3 is applied to the first clock terminal CLKB such that the ninth transistor M9 and the fifth transistor M5 are turned on to supply the high level of the third clock signal CLK3 to the second node PD_CN and the third node PD. As the third node PD is at the high level, the tenth transistor M10 is turned on to cause the first capacitor C1 to be discharged, and the eleventh transistor M11 is turned on to maintain the gate signal that is output via the output terminal OUTPUT to the gate line GL1 at a low level.

The operations of the second stage ST2 are described below.

At phase P1, the high level of the first scan start signal STV_F is applied to the input terminal INPUT such that the first transistor M1 is turned on to supply the first clock signal CLK1 to the first node PU via the second clock terminal CLKB'. At the second half of phase P1, the first capacitor C1 is charged with the high level of the first clock signal CLK1, such that the sixth transistor M6 and the eighth transistor M8 are turned on to supply the gate-off voltage to the second node PD_CN and the third node PD via the gate-off voltage terminal VSS, and the third transistor M3 is turned on to prepare outputting of a high level to the gate line GL2 via the output terminal OUTPUT.

At phase P2, the high level of the second clock signal CLK2 is applied to the third clock terminal CLK, and the voltage across the first capacitor C1 maintains the third transistor M3 in an ON state, such that the high level of the second clock signal CLK2 is supplied via the third transistor M3 to the output terminal OUTPUT and output to the gate line GL2.

At phase P3, the high level of the fourth stage ST4 (GL4) is applied to the reset terminal RESET of the second stage ST2 such that the fourth transistor M4 is turned on to supply the gate-off voltage to the output terminal OUTPUT via the gate-off voltage terminal VSS, pulling the gate signal output to the gate line GL2 down to a low level. At the same time, the second transistor M2 is turned on to supply the third clock signal CLK3 to the first node PU via the fourth clock terminal CLK'. At the second half of phase P3, the low level of the third clock signal CLK3 is supplied to the first node PU to cause the first capacitor C1 to be discharged.

At phase P4, the transistors are in an OFF state such that the output terminal OUTPUT is floated at a low level. The gate signal output to the gate line GL2 is at the low level.

At phase P5, the high level of the fourth clock signal CLK4 is applied to the first clock terminal CLKB such that the ninth transistor M9 and the fifth transistor M5 are turned on to supply the high level of the fourth clock signal CLK4 to the second node PD_CN and the third node PD. As the third node PD is at the high level, the tenth transistor M10 is turned on to cause the first capacitor C1 to be discharged, and the eleventh transistor M11 is turned on to maintain the gate signal that is output via the output terminal OUTPUT to the gate line GL2 at a low level.

The operations of the third stage ST3 are described below.

At phase P1, the high level output by the first stage ST1 is applied to the input terminal INPUT such that the first transistor M1 is turned on to supply the second clock signal CLK2 to the first node PU via the second clock terminal CLKB'. At the second half of phase P1, the first capacitor C1 is charged with the high level of the second clock signal CLK2, such that the sixth transistor M6 and the eighth transistor M8 are turned on to supply the gate-off voltage to the second node PD_CN and the third node PD via the gate-off voltage terminal VSS, and the third transistor M3 is turned on to prepare outputting of a high level to the gate line GL3 via the output terminal OUTPUT.

At phase P2, the high level of the third clock signal CLK3 is applied to the third clock terminal CLK, and the voltage across the first capacitor C1 maintains the third transistor M3 in an ON state, such that the high level of the third clock signal CLK3 is supplied via the third transistor M3 to the output terminal OUTPUT and output to the gate line GL3.

At phase P3, the high level of the fifth stage ST5 (GL5) is applied to the reset terminal RESET of the third stage ST3 such that the fourth transistor M4 is turned on to supply the gate-off voltage to the output terminal OUTPUT via the gate-off voltage terminal VSS, pulling the gate signal output to the gate line GL3 down to a low level. At the same time, the second transistor M2 is turned on to supply the fourth clock signal CLK4 to the first node PU via the fourth clock terminal CLK'. At the second half of phase P3, the low level of the fourth clock signal CLK4 is supplied to the first node PU to cause the first capacitor C1 to be discharged.

At phase P4, the transistors are in an OFF state such that the output terminal OUTPUT is floated at a low level. The gate signal output to the gate line GL3 is at the low level.

At phase P5, the high level of the first clock signal CLK1 is applied to the first clock terminal CLKB such that the ninth transistor M9 and the fifth transistor M5 are turned on to supply the high level of the first clock signal CLK1 to the second node PD_CN and the third node PD. As the third node PD is at the high level, the tenth transistor M10 is turned on to cause the first capacitor C1 to be discharged, and the eleventh transistor M11 is turned on to maintain the gate signal that is output via the output terminal OUTPUT to the gate line GL3 at a low level.

The operations of the fourth stage ST4 are described below.

At phase P1, the high level output by the second stage ST2 is applied to the input terminal INPUT such that the first transistor M1 is turned on to supply the third clock signal CLK3 to the first node PU via the second clock terminal CLKB'. At the second half of phase P1, the first capacitor C1 is charged with the high level of the third clock signal CLK3, such that the sixth transistor M6 and the eighth transistor M8 are turned on to supply the gate-off voltage to the second node PD_CN and the third node PD via the gate-off voltage terminal VSS, and the third transistor M3 is turned on to prepare outputting of a high level to the gate line GL4 via the output terminal OUTPUT.

At phase P2, the high level of the fourth clock signal CLK4 is applied to the third clock terminal CLK, and the voltage across the first capacitor C1 maintains the third transistor M3 in an ON state, such that the high level of the fourth clock signal CLK4 is supplied via the third transistor M3 to the output terminal OUTPUT and output to the gate line GL4.

At phase P3, the high level output by the sixth stage ST6 (GL6) is applied to the reset terminal RESET of the fourth stage ST4 such that the fourth transistor M4 is turned on to supply the gate-off voltage to the output terminal OUTPUT via the gate-off voltage terminal VSS, pulling the gate signal output to the gate line GL4 down to a low level. At the same time, the second transistor M2 is turned on to supply the first clock signal CLK1 to the first node PU via the fourth clock terminal CLK'. At the second half of phase P3, the low level of the first clock signal CLK1 is supplied to the first node PU to cause the first capacitor C1 to be discharged.

At phase P4, the transistors are in an OFF state such that the output terminal OUTPUT is floated at a low level. The gate signal output to the gate line GL4 is at the low level.

At phase P5, the high level of the second clock signal CLK2 is applied to the first clock terminal CLKB such that the ninth transistor M9 and the fifth transistor M5 are turned on to supply the high level of the second clock signal CLK2 to the second node PD_CN and the third node PD. As the third node PD is at the high level, the tenth transistor M10 is turned on to cause the first capacitor C1 to be discharged, and the eleventh transistor M11 is turned on to maintain the gate signal that is output via the output terminal OUTPUT to the gate line GL4 at a low level.

The operations of the succeeding stages are omitted for simplicity. It will be understood that although the first scan start signal STV_F is described in the above embodiments as having a pulse width of 1.5H, the first scan start signal STV_F may also have a pulse with of 1H in other embodiments.

Figure 6A:
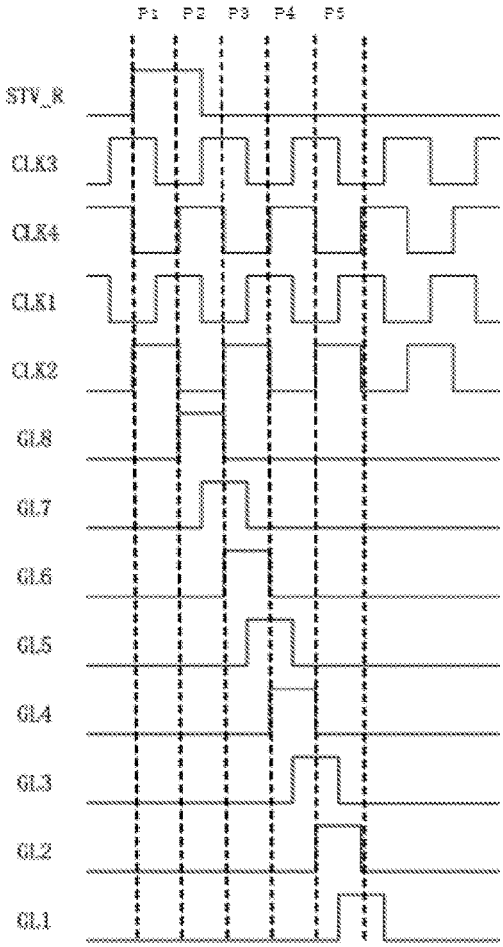
FIGS. 6A and 6B are timing diagrams schematically illustrating operations of the eighth and seventh stages of the gate driving circuit as shown in FIG. 2 in a reverse scanning mode, respectively.
Figure 6B:
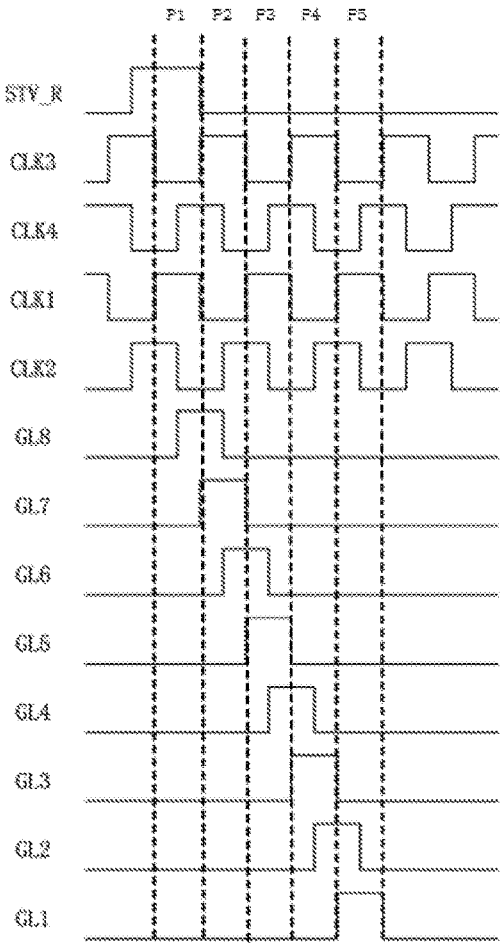

FIGS. 6A and 6B are timing diagrams schematically illustrating operations of the eighth and seventh stages of the gate driving circuit 200 (n=8) as shown in FIG. 2 in a reverse scanning mode, respectively. The operations of each stage comprise five phases P1, P2, P3, P4 and P5.

The operations of the eighth stage ST8 are described below.

At phase P1, the high level of STV_R is applied to the reset terminal RESET such that the second transistor M2 is turned on to supply the first clock signal CLK1 to the first node PU via the fourth clock terminal CLK'. At the second half of phase P1, the first capacitor C1 is charged with the high level of the first clock signal CLK1, such that the sixth transistor M6 and the eighth transistor M8 are turned on to supply the gate-off voltage to the second node PD_CN and the third node PD via the gate-off voltage terminal VSS, and the third transistor M3 is turned on to prepare outputting of a high level to the gate line GL8 via the output terminal OUTPUT.

At phase P2, the high level of the fourth clock signal CLK4 is applied to the third clock terminal CLK, and the voltage across the first capacitor C1 maintains the third transistor M3 in an ON state, such that the high level of the fourth clock signal CLK4 is supplied via the third transistor M3 to the output terminal OUTPUT and output to the gate line GL8.

At phase P3, the high level output by the sixth stage ST6 (GL6) is applied to the input terminal INPUT of the eighth stage ST8 such that the seventh transistor M7 is turned on to supply the gate-off voltage to the output terminal OUTPUT via the gate-off voltage terminal VSS, pulling the gate signal output to the gate line GL8 down to a low level. At the same time, the first transistor M1 is turned on to supply the third clock signal CLK3 to the first node PU via the second clock terminal CLKB'. At the second half of phase P3, the low level of the third clock signal CLK3 is supplied to the first node PU to cause the first capacitor C1 to be discharged.

At phase P4, the transistors are in an OFF state such that the output terminal OUTPUT is floated at a low level. The gate signal output to the gate line GL8 is at the low level.

At phase P5, the high level of the second clock signal CLK2 is applied to the first clock terminal CLKB such that the ninth transistor M9 and the fifth transistor M5 are turned on to supply the high level of the second clock signal CLK2 to the second node PD_CN and the third node PD. As the third node PD is at the high level, the tenth transistor M10 is turned on to cause the first capacitor C1 to be discharged, and the eleventh transistor M11 is turned on to maintain the gate signal that is output via the output terminal OUTPUT to the gate line GL8 at a low level.

The operations of the seventh stage ST7 are described below.

At phase P1, the high level of STV_R is applied to the reset terminal RESET such that the second transistor M2 is turned on to supply the fourth clock signal CLK4 to the first node PU via the fourth clock terminal CLK'. At the second half of phase P1, the first capacitor C1 is charged with the high level of the fourth clock signal CLK4, such that the sixth transistor M6 and the eighth transistor M8 are turned on to supply the gate-off voltage to the second node PD_CN and the third node PD via the gate-off voltage terminal VSS, and the third transistor M3 is turned on to prepare outputting of a high level to the gate line GL7 via the output terminal OUTPUT.

At phase P2, the high level of the third clock signal CLK3 is applied to the third clock terminal CLK, and the voltage across the first capacitor C1 maintains the third transistor M3 in an ON state, such that the high level of the third clock signal CLK3 is supplied via the third transistor M3 to the output terminal OUTPUT and output to the gate line GL7.

At phase P3, the high level output by the fifth stage ST5 (GL5) is applied to the input terminal INPUT of the seventh stage ST7 such that the seventh transistor M7 is turned on to supply the gate-off voltage to the output terminal OUTPUT via the gate-off voltage terminal VSS, pulling the gate signal output to the gate line GL7 down to a low level. At the same time, the first transistor M1 is turned on to supply the second clock signal CLK2 to the first node PU via the second clock terminal CLKB'. At the second half of phase P3, the low level of the second clock signal CLK2 is supplied to the first node PU to cause the first capacitor C1 to be discharged.

At phase P4, the transistors are in an OFF state such that the output terminal OUTPUT is floated at a low level. The gate signal output to the gate line GL7 is at the low level.

At phase P5, the high level of the first clock signal CLK1 is applied to the first clock terminal CLKB such that the ninth transistor M9 and the fifth transistor M5 are turned on to supply the high level of the first clock signal CLK1 to the second node PD_CN and the third node PD. As the third node PD is at the high level, the tenth transistor M10 is turned on to cause the first capacitor C1 to be discharged, and the eleventh transistor M11 is turned on to maintain the gate signal that is output via the output terminal OUTPUT to the gate line GL7 at a low level.

The operations of the succeeding stages are omitted for simplicity. It will be understood that although the second scan start signal STV_R is described in the above embodiments as having a pulse width of 1.5H, the second scan start signal STV_R may also have a pulse with of 1H in other embodiments.

According to embodiments of the present disclosure, the gate driving circuit is enabled to perform forward scanning and reverse scanning by using the first scan start signal STV_F and the second scan start signal STV_R and by changing the timing of the clock signals, without a need of additional signal lines.

Various modifications, adaptations to the foregoing exemplary embodiments of this disclosure may become apparent to those skilled in the relevant arts in view of the foregoing description, when read in conjunction with the accompanying drawings. Any and all modifications will still fall within the scope of the non-limiting and exemplary embodiments of this disclosure. Furthermore, other embodiments of the disclosure set forth herein will come to mind to one skilled in the art to which these embodiments of the disclosure pertain having the benefit of the teachings presented in the foregoing descriptions and the associated drawings.

Therefore, it is to be understood that the embodiments of the disclosure are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A gate driving circuit, comprising:

n stages that are sequentially arranged, n being an integer larger than or equal to 4, wherein the n stages are divided into a first set of stages comprising a (4k+1)-th stage of the n stages, a second set of stages comprising a (4k+2)-th stage of the n stages, a third set of stages comprising a (4k+3)-th stage of the n stages, and a fourth set of stages comprising a 4(k+1)-th stage of the n stages, k being an integer larger than or equal to 0, and wherein the first, second, third and fourth sets of stages are configured to receive respective different combinations of a first clock signal, a second clock signal, a third clock signal and a fourth clock signal, a first clock line for transmitting the first clock signal, a second clock line for transmitting the second clock signal, a third clock line for transmitting the third clock signal, a fourth clock line for transmitting the fourth clock signal, a first scan start signal line for transmitting the first scan start signal, and a second scan start signal line for transmitting the second scan start signal, wherein the stages in the first set of stages and the stages in the third set of stages are cascaded with each other, and the stages in the second set of stages and the stages in the fourth set of stages are cascaded with each other, wherein first two of the n stages are configured to receive a first scan start signal and last two of the n stages are configured to receive a second scan start signal, wherein each of the n stages comprises a first clock terminal, a second clock terminal, a third clock terminal and a fourth clock terminal, wherein the first clock line is connected to the third clock terminal of each stage in the first set of stages, the second clock terminal of each stage in the second set of stages, the first clock terminal of each stage in the third set of stages, and the fourth clock terminal of each stage in the fourth set of stages, wherein the second clock line is connected to the fourth clock terminal of each stage in the first set of stages, the third clock terminal of each stage in the second set of stages, the second clock terminal of each stage in the third set of stages, and the first clock terminal of each stage in the fourth set of stages, wherein the third clock line is connected to the first clock terminal of each stage in the first set of stages, the fourth clock terminal of each stage in the second set of stages, the third clock terminal of each stage in the third set of stages, and the second clock terminal of each stage in the fourth set of stages, wherein the fourth clock line is connected to the second clock terminal of each stage in the first set of stages, the first clock terminal of each stage in the second set of stages, the fourth clock terminal of each stage in the third set of stages, and the third clock terminal of each stage in the fourth set of stages, wherein each of the n stages further comprises an input terminal, an output terminal, a reset terminal, and a gate-off voltage terminal configured to receive a gate-off voltage, wherein the output terminal of each stage in the first set of stages is connected to the input terminal of a respective next stage in the third set of stages, and the output terminal of each stage in the third set of stages is connected to the reset terminal of a respective previous stage in the first set of stages and the input terminal of a respective next stage in the first set of stages, wherein the output terminal of each stage in the second set of stages is connected to the input terminal of a respective next stage in the fourth set of stages, and the output terminal of each stage in the fourth set of stages is connected to the reset terminal of a respective previous stage in the second set of stages and the input terminal of a respective next stage in the second set of stages, and wherein the input terminals of the first two of the n stages are connected to the first scan start signal line, and the reset terminals of the last two of the n stages are connected to the second scan start signal line.

2. The gate driving circuit of claim 1, wherein each of the n stages comprises:

a first node;

a buffering part operable to selectively supply to the first node a signal applied to the second clock terminal or a signal applied to the fourth clock terminal in dependence on a signal applied to the input terminal and a signal applied to the reset terminal;

a charging part operable to be charged with the signal supplied by the buffering part to the first node;

a pull-up part operable to selectively supply a signal applied to the third clock terminal to the output terminal in dependence on a voltage at the first node;

a pull-down part operable to supply a signal applied to the gate-off voltage terminal to the output terminal in dependence on the signal applied to the input terminal and the signal applied to the reset terminal; and a holding part operable to hold supplying of the signal applied to the gate-off voltage terminal to the output terminal in dependence on a signal applied to the first clock terminal.

3. The gate driving circuit of claim 2, wherein the buffering part comprises a first transistor and a second transistor, wherein the first transistor comprises a gate electrode connected to the input terminal, a first electrode connected to the first node, and a second electrode connected to the second clock terminal, and wherein the second transistor comprises a gate electrode connected to the reset terminal, a first electrode connected to the fourth clock terminal, and a second electrode connected to the first node.

4. The gate driving circuit of claim 3, wherein the charging part comprises a first capacitor comprising a first terminal connected to the first node and a second terminal connected to the output terminal.

5. The gate driving circuit of claim 4, wherein the pull-up part comprises a third transistor comprising a gate electrode connected to the first node, a first electrode connected to the output terminal, and a second electrode connected to the third clock terminal.

6. The gate driving circuit of claim 5, wherein the pull-down part comprises a fourth transistor and a seventh transistor, wherein the fourth transistor comprises a gate electrode connected to the reset terminal, a first electrode connected to the gate-off voltage terminal, and a second electrode connected to the output terminal, and wherein the seventh transistor comprises a gate electrode connected to the input terminal, a first electrode connected to the gate-off voltage terminal, and a second electrode connected to the output terminal.

7. The gate driving circuit of claim 6, wherein each of the n stages further comprises a second node and a third node, and wherein the holding part comprises a fifth transistor, a ninth transistor, a tenth transistor and an eleventh transistor, the fifth transistor comprising a gate electrode connected to the second node, a first electrode connected to the third node, and a second electrode connected to the first clock terminal, the ninth transistor comprising a gate electrode connected to the first clock terminal, a first electrode connected to the second node, and a second electrode connected to the first clock terminal, the tenth transistor comprising a gate electrode connected to the third node, a first electrode connected to the gate-off voltage terminal, and a second electrode connected to the first node, the eleventh transistor comprising a gate electrode connected to the third node, a first electrode connected to the gate-off voltage terminal, and a second electrode connected to the output terminal.

8. The gate driving circuit of claim 7, wherein the buffering part further comprises a sixth transistor and an eighth transistor, wherein the sixth transistor comprises a gate electrode connected to the first node, a first electrode connected to the gate-off voltage terminal, and a second electrode connected to the third node, and wherein the eighth transistor comprises a gate electrode connected to the first node, a first electrode connected to the gate-off voltage terminal, and a second electrode connected to the second node.

9. The gate driving circuit claim 1, wherein the gate driving circuit is configured to operate in a forward scanning mode in response to application of the first scan start signal to the input terminals of the first two of the n stages.

10. The gate driving circuit of claim 9, wherein each of the first, second, third and fourth clock signals is a pulse signal periodically repeated with a period of 2H, wherein: H is a horizontal scan period, the first clock signal and the third clock signal have a phase difference of 180 degrees, the second clock signal and the fourth clock signal have a phase difference of 180 degrees, and the first clock signal precedes the fourth clock signal by 90 degrees in terms of the phase.

11. The gate driving circuit of claim 10, wherein the first scan start signal is a pulse signal having a pulse width of 1.5H or 1H, and wherein a rising edge of the first scan start signal is synchronized with a rising edge of the third clock signal.

12. The gate driving circuit of claim 1, wherein the gate driving circuit is configured to operate in a reverse scanning mode in response to application of the second scan start signal to the reset terminals of the last two of the n stages.

13. The gate driving circuit of claim 12, wherein each of the first, second, third and fourth clock signals is a pulse signal periodically repeated with a period of 2H, wherein: H is a horizontal scan period, the first clock signal and the third clock signal have a phase difference of 180 degrees, the second clock signal and the fourth clock signal have a phase difference of 180 degrees, and the first clock signal falls behind the fourth clock signal by 90 degrees in terms of the phase.

14. The gate driving circuit of claim 13, wherein the second scan start signal is a pulse signal having a pulse width of 1.5H or 1H, and wherein a rising edge of the second scan start signal is synchronized with a rising edge of the second clock signal.

15. A method of driving a display panel including an array substrate, the array substrate comprising:

a display area comprising a plurality of gate lines and a plurality of data lines intersecting the plurality of gate lines; and the gate driving circuit as claimed in claim 1, wherein the gate driving circuit is formed in a peripheral area of the array substrate other than the display area and configured to supply gate signals to the plurality of gate lines, the method comprising:

driving the display panel to operate in a forward scanning mode by supplying the gate driving circuit with the first, second, third and fourth clock signals and the first scan start signal, wherein: each of the first, second, third and fourth clock signals is a pulse signal periodically repeated with a period of 2H, H is a horizontal scan period, the first clock signal and the third clock signal have a phase difference of 180 degrees, the second clock signal and the fourth clock signal have a phase difference of 180 degrees, the first clock signal precedes the fourth clock signal by 90 degrees in terms of the phase, the first scan start signal is a pulse signal having a pulse width of 1.5H or 1H, and a rising edge of the first scan start signal is synchronized with a rising edge of the third clock signal; and driving the display panel to operate in a reverse scanning mode by supplying the gate driving circuit with the first, second, third and fourth clock signals and the second scan start signal, wherein: each of the first, second, third and fourth clock signals is a pulse signal periodically repeated with a period of 2H, H is a horizontal scan period, the first clock signal and the third clock signal have a phase difference of 180 degrees, the second clock signal and the fourth clock signal have a phase difference of 180 degrees, the first clock signal falls behind the fourth clock signal by 90 degrees in terms of the phase, the second scan start signal is a pulse signal having a pulse width of 1.5H or 1H, and a rising edge of the second scan start signal is synchronized with a rising edge of the second clock signal.

* * * * *